United States Patent [19]

Hymmen

[11] Patent Number: 4,656,907

[45] Date of Patent: Apr. 14, 1987

[54] PAPER PUNCH

[75] Inventor: Karl Hymmen, Sparks, Nev.

[73] Assignee: Velobind, Inc., Sunnyvale, Calif.

[21] Appl. No.: 771,512

[22] Filed: Aug. 30, 1985

[51] Int. Cl.[4] ..... B26F 1/02

[52] U.S. Cl. ..... 83/571; 83/167; 83/588; 83/618; 83/633; 83/698; 412/43

[58] Field of Search ..... 83/618–620, 83/625–627, 632, 698, 633, 549, 635, 571, 588, 167; 412/38, 43

[56] References Cited

U.S. PATENT DOCUMENTS

| | | | |
|---|---|---|---|
| 2,017,195 | 10/1935 | Anderson et al. | 83/618 |
| 2,481,883 | 9/1949 | Semler | 83/618 |
| 4,036,088 | 7/1977 | Ruskin | 83/618 |
| 4,449,436 | 5/1984 | Semerjian et al. | 83/633 |

FOREIGN PATENT DOCUMENTS

| | | | |
|---|---|---|---|
| 1436161 | 10/1968 | Fed. Rep. of Germany | 83/633 |
| 2422023 | 11/1974 | Fed. Rep. of Germany | 83/588 |

*Primary Examiner*—Frank T. Yost
*Assistant Examiner*—Hien H. Phan
*Attorney, Agent, or Firm*—Julian Caplan

[57] ABSTRACT

A hand-operated punch is formed of molded parts which interfit for easy and rapid assembly and disassembly. This feature is particularly useful if there are paper jams. A handle hooks under a wall of the base. Depressing the handle forces downward a transverse bar recessed to accept the upper ends of the male punch elements, which are spring-biased to travel with the transverse bar. The punch elements reciprocate within a die bar detachably connected to the base. The die bar is formed with a throat for insertion of papers to be punched. The front edge of the base is formed with a transverse groove to accept a male binder element during assembly of a book comprised of the punched paper.

8 Claims, 11 Drawing Figures

PAPER PUNCH

BACKGROUND OF THE INVENTION

1. Field of the Invention

This invention relates to a new and improved hand operated paper punch characterized by the fact that the parts thereof are preferably of a moldable material and are so assembled and held in assembled position that they may readily be disassembled for repair, to relieve jamming, and for other purposes.

2. Description of Related Art

Hand operated paper punches of this general type have been used commercially for many years. However, such machines have generally been made of metal and their assembly and disassembly require use of tools and mechanical skill. The simplicity of construction and operation of the present invention and the ease and rapidity with which the punch may be assembled and disassembled distinguishes over prior punches of this general type.

SUMMARY OF THE INVENTION

In accordance with the present invention a base having a paper platen has an upstanding back extending transversely of the device. Extending transversely below the level of the platen is a support upon which rests a die bar which snaps into position between the platen and the rear of the base. The die bar is formed with a throat to receive pages to be punched and below the throat is a die member, the number and spacing of the holes in the die depending upon the number of holes to be punched.

Vertically reciprocating within the punch between sides on either side of the base is a punch bar formed with cavities corresponding to the spacing of the holes to be punched. Each cavity receives an individual male punch die and a return spring. When the punch bar is depressed, all of the dies are moved downward from a retracted position to a protracted position, the dies on the bottoms of the pins intersecting the throat to punch pages located in the throat. A handle is located above the punch bar and has a hook which interfits with a cooperating hook on the rear of the base. When the handle is depressed, the handle pivots relative to the base and depresses the punch bar, causing all of the punch ends to be moved from retracted to protracted positions. Upon release of the handle, the springs return the handle, punch bar and pins to initial position.

In order to disassemble the punch, the handle is depressed vertically against the force of the springs, tending to depress the punch bar until the hooks on the handle and base back are disengaged. Thereupon by twisting the handle upwardly it may be disengaged from the base and removed. This provides access to the punch bar which may also be removed, providing access to the individual punch pins, any one of which may be removed. If any punch pin has been jammed in a previous punching operation, it may readily be disengaged once the punch bar has been removed. If further disassembly of the punch is desired, the die bar may be snapped out of engagement with the base.

One preferred use of the punch is in punching pages for assembly with bookbinding strips of the type having bendable studs which pass through holes in the pages, and thence through holes in the second or female strip, the latter strip being formed with channels to receive the bent over portions of the studs in proximity to the holes formed therein. The punch of the present invention, to facilitate this assembly, may be formed with a transverse groove at the front of the platen. The male strip is lodged in the groove with the studs uppermost. As the pages are punched, the studs are inserted through the holes until all of the sheets to be bound into the book have been located on the studs. Thereupon the female strip is installed over the studs and a tool or the fingers may be used to bend over the flexible studs until they snap into the channels on the outside edges of the groove of the female strip.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
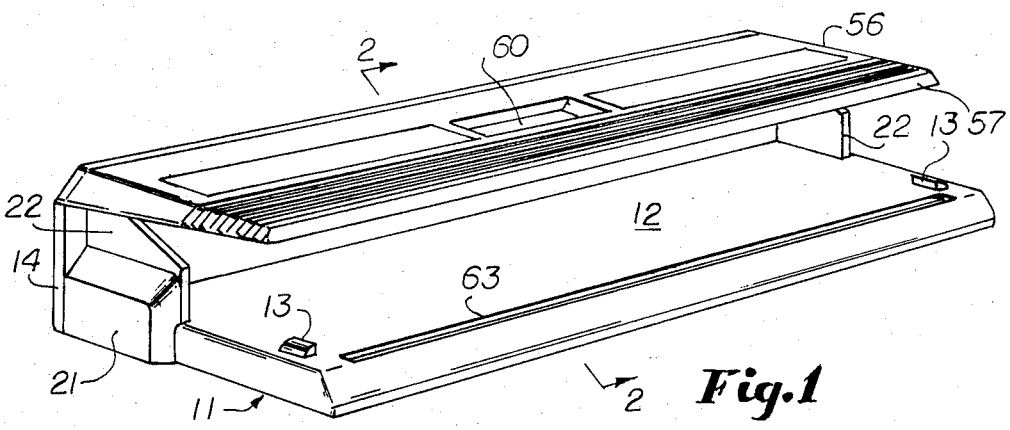
FIG. 1 is a perspective view of the punch in accordance with the present invention.

The punch is preferably made of molded plastic parts of a material such as ABS or PVC. A feature of the invention is the fact that the parts may snap into place and be held assembled without the use of separate fasteners. For this purpose there is provided a base 11 having an upwardly rearwardly slanted platen 12 to support pages to be bound. On either side of platen 12 is a paper edge guide 13. Extending vertically upwardly of base 11 is a back 14. Spaced below the top edge of back 14 are downward directed hooks 16. Near the bottom of back 14 are catches 17 on the ends of vertically extended catch arms 18. Catches 17 may move forward and rearward by reason of flexibility of arms 18. On either side of base 11 near the rear thereof is a boss 21 having upstanding sides 22. Projecting inward of side guides 22 are a pair of vertical ribs 23 having a purpose hereinafter described.

Extending transversely of base 11 is a support 26 in the shape of an inverted channel having longitudinally spaced apart holes 27 larger than the holes which the device is intended to punch. The top of support 26 is below the elevation of the rear of platen 12. Below support 26 and fitting within the channel shape thereof is a slug receiving receptor 28 which catches the punched circles which drop through holes 27. Receptor 28 has side edge flanges 29 formed with notches at intervals and support 26 has ears 25 shaped to fit in notches 30. At one position, the ears 25 permit the receptor to be raised within the channel of support 26 because they enter the notches 30. By sliding receptor 28 longitudinally the ears 25 are out of alignment with notches 30 and support flanges 29.

Resting upon support 26 is transverse die bar 31 which has ledges 32 at its rear. Catches 17 engage ledges 32 and restrain it from being lifted. At the forward edge of die bar 31 there are bevels 33 which snap under bevels 34 on the rearward edge of platen 12. Hence to insert the die bar in place, it is first tilted so that the bevels 33 engage under the bevels 34 and then depressed so that the catches 17 are deflected rearwardly and then snap over the ledges 32.

Die bar 31 has a throat 36 formed therein which is at the level of the platen 12. The depth of throat 36 determines the distance from the rearward edge of the paper being punched that the holes formed therein are located. To assist the paper entering the throat 36 there is a downward rearward slanted guide 37 above the platen 12. Sides 22 also assist in guiding the paper into position, as do paper guides 13. Extending upwardly of die bar 31 at spaced intervals corresponding to the spacing of the holes to be punched are bosses 39. Bores 38 are formed in the die bar 31 extending down through the bosses 39 and thence through the body of the die bar into registry with the holes 27. It will be seen that bores 38 intersect throat 36.

Vertically reciprocating above the die bar 31 is a transverse punch bar 41 having cavities 42 corresponding in number to the bores 38 formed extending upward from its bottom surface in alignment with the bores 38. Each cavity 42 has a lesser diameter extension 45 at its upper end. The punch bar 41 has a flat top 43. At either end of bar 41 extending rearwardly to adjacent the back 14 are fingers 44 which guide movement thereof to prevent forward-rearward swaying.

Received in each cavity 42 is a punch pin 46 formed with a male punch die 47 at its bottom end. Near the top of each pin 46 is an E-ring fitting in an appropriate groove in the pin 46. Coil springs 49 at their upper ends bear against the E-rings 48. The lower ends of the springs 48 surround bosses 39 and bear against the die bar 31. The portion of pin 46 above E-ring 48 extends into extension 45. Hence the springs 49 bias the punch pins 46 upward in the cavities 42 and also bias the punch bar 41 upwardly. Downward projections on the ends of bar 41 limit downward movement thereof.

At either end of punch bar 41 is an enlargement formed with a slot 52 into which fits rib 23. Hence the punch bar may reciprocate vertically relative to base 11 causing the reciprocation of the punch pins 46 against the return force of the springs 49.

Figure 2:
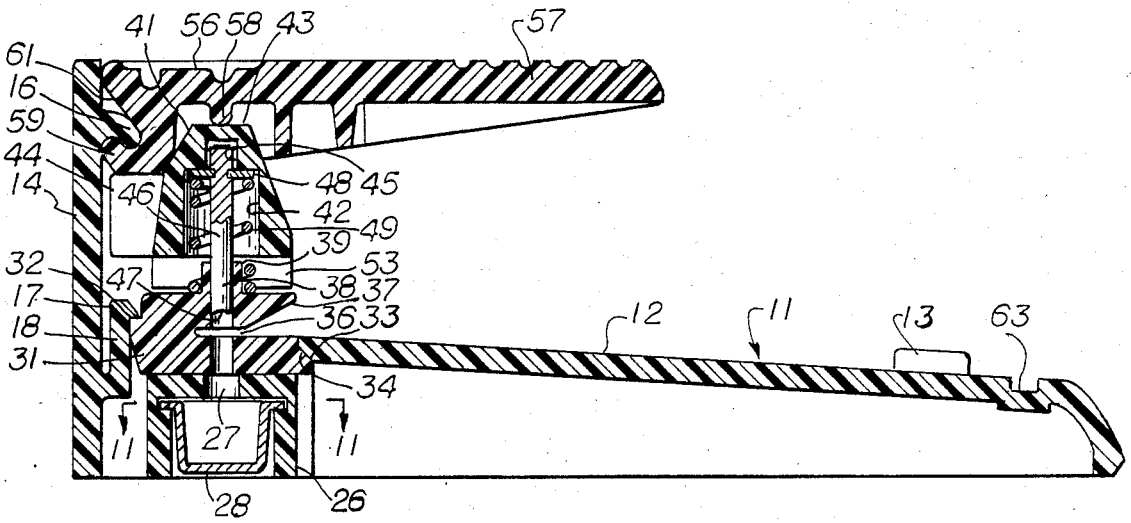
FIG. 2 is a vertical sectional view taken substantially along the line 2—2 of FIG. 1 showing the punch in retracted position.
Figure 3:
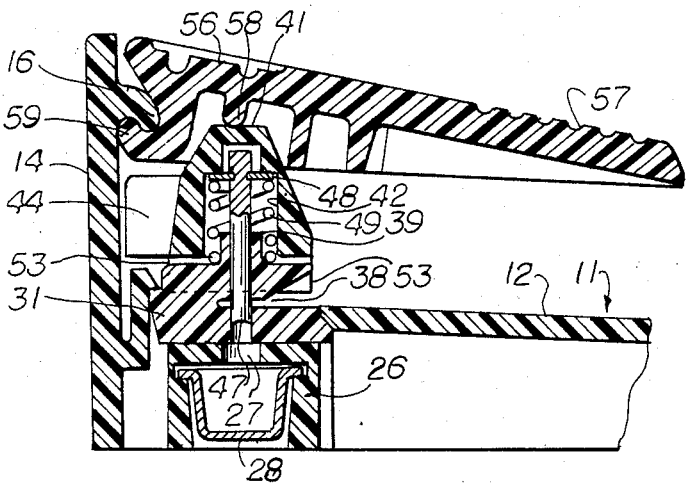
FIG. 3 is a partial view of the structure of FIG. 2 showing the punch at the completion of the punching action.

Handle 56 is formed as a lever 57 at its forward end which is pushed by the fingers of the user. Lever 57 may be formed with a window 60 so that the user may observe proper location of the sheets to be bound in throat 36. On its lower surface it has a ridge 58 which bears against the top 43 of punch bar 41. Rearwardly of and below the level of ridge 58 are second hooks 59 which, as best shown in FIGS. 2 and 3, engage under hooks 16. Hooks 59 fit over fingers 44. Hook 59 merges with an upwardly rearwardly slanted surface 61.

In operation of the punch, the user depresses the lever 57 causing the punch to move from the position of FIG. 2 to the position of FIG. 3 whereby the ridge 59 depresses the punch bar 41 causing the punch pins 46 to be depressed and to punch pages inserted in throat 38 as has heretofore been explained. When the lever 57 is released, springs 49 return the handle 56 to the position shown in FIG. 2.

Figure 4:
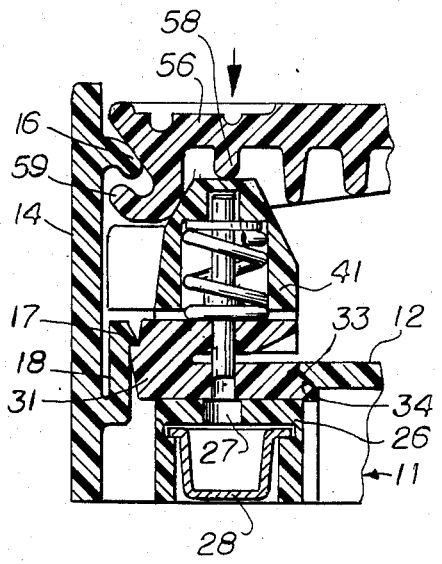
FIG. 4 is a partial view of the structure of FIG. 1 showing depression of the handle preparatory to disassembly of the punch.
Figure 5:
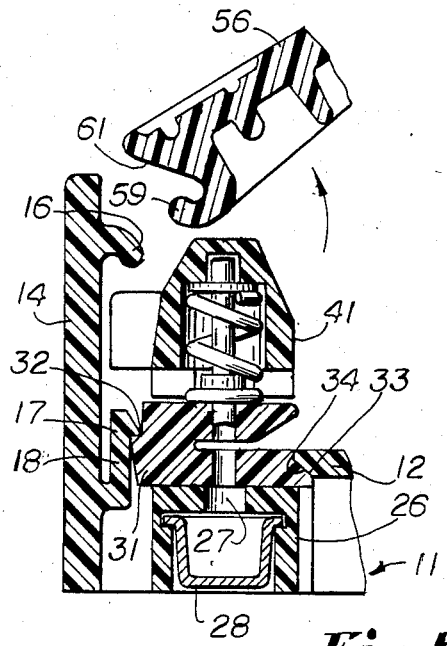
FIG. 5 is a view showing the handle disassembled from the remainder of the punch.
Figure 6:
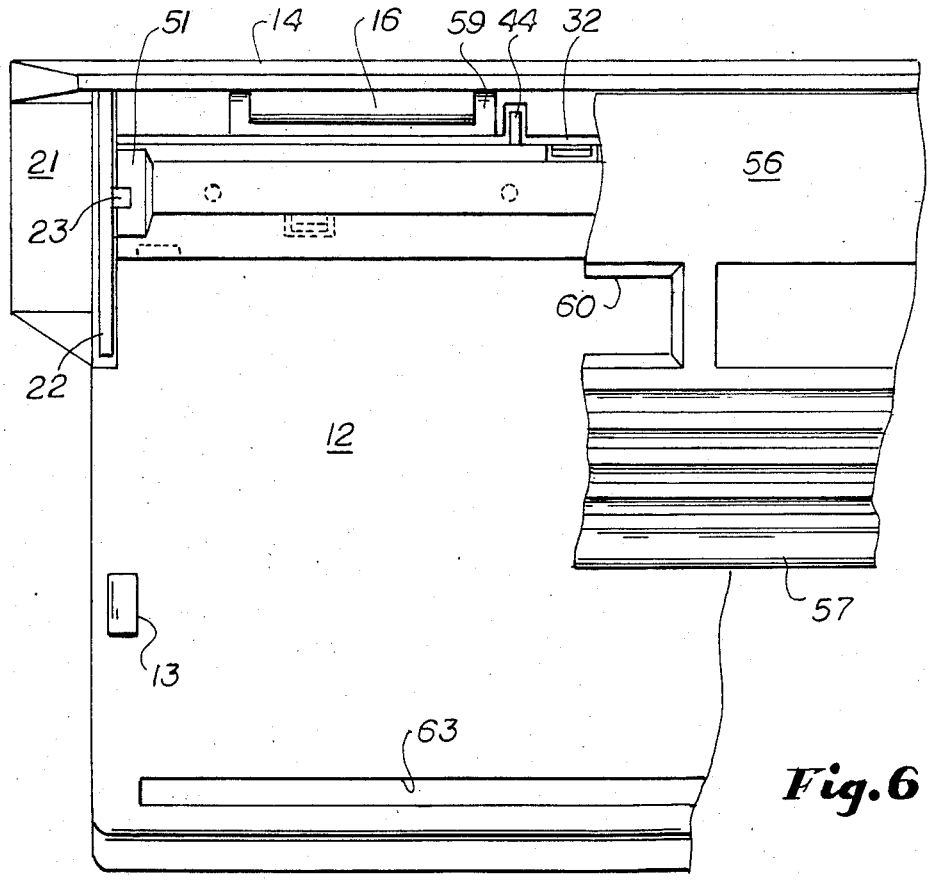
FIG. 6 is a top plan of a portion of the punch partially broken away to reveal internal construction.
Figure 7:
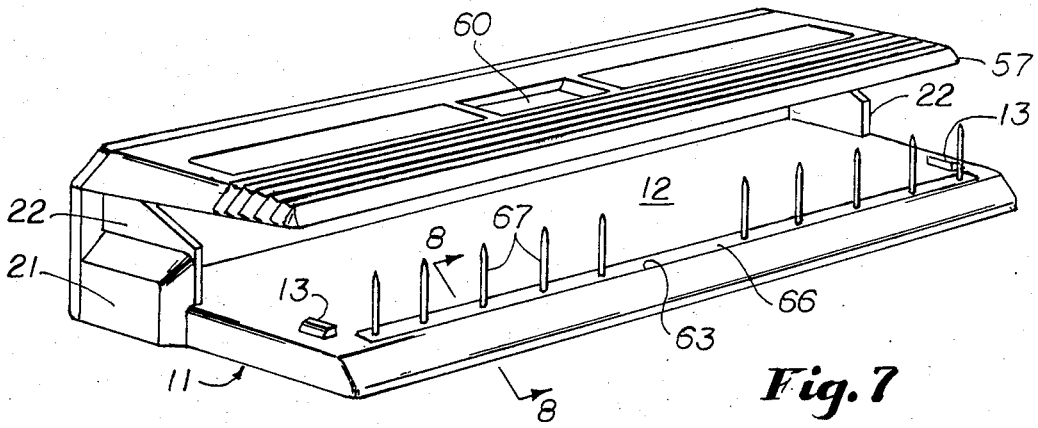
FIG. 7 is a view similar to FIG. 1 showing a male binding strip inserted in the groove in the front of the platen.
Figure 8:
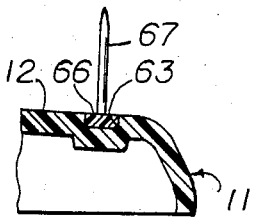
FIG. 8 is a fragmentary sectional view taken substantially along the line 8—8 of FIG. 7.
Figure 9:
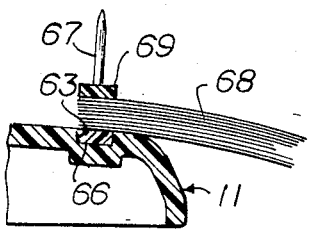
FIG. 9 is a view similar to FIG. 8 showing sheets and a female strip assembled.
Figure 10:
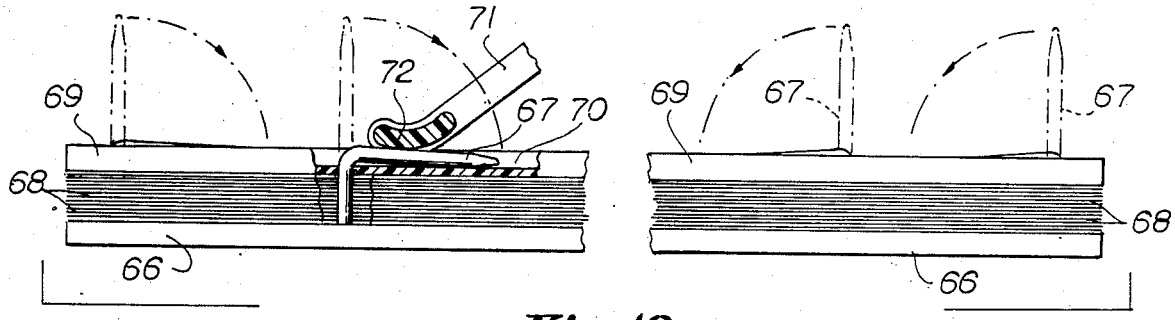
FIG. 10 is an enlarged fragmentary front elevational view showing a step in bending over the studs shown in FIGS. 8 and 9.
Figure 11:
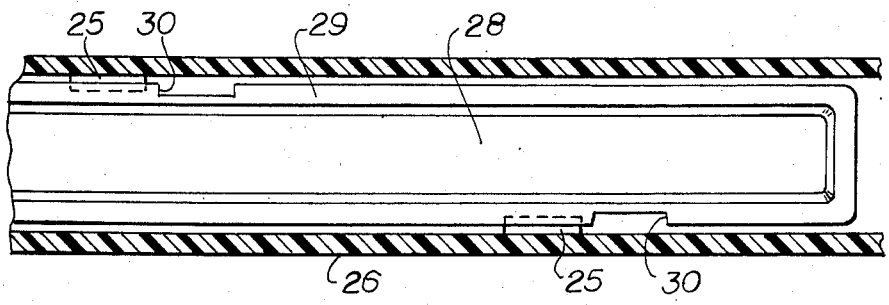
FIG. 11 is a fragmentary sectional view taken substantially along line 11—11 of FIG. 2.

To disassemble the punch from the position shown in FIG. 2, the first step is shown in FIG. 4 whereby the handle 56 has been vertically depressed so that the hook 59 is below the level of the hook 16. This depression is accomplished by reason of the fact that the punch bar 41 is depressed against the force of the springs 49. The next step in disassembly is to tilt the handle 56 upwardly as shown in FIG. 7 causing the handle 56 to be disengaged from the base 11. Removal of handle 56 provides access to the punch bar 41. Any one or more of the punch pins 46 may be raised relative to die bar 31 if it has been stuck therein. For such purpose, the punch bar 41 is simply raised and removed, leaving the pins 46 in the bores 38 of the bosses 39.

If further disassembly is desired, the die bar 31 is pushed rearwardly, causing the catches 17 to be pushed back until the bevels 33, 34 disengage. Of course, a more frequent disassembly operation is the removal of the slug cavity 28 in order to dump the paper slugs which have accumulated therein.

Reassembly of the punch (as well, indeed, as the initial assembly thereof) is accomplished by reversal of the operations for disassembly.

Groove 63 may be provided extending transversely across platen 12 near the front thereof. One use for the punch of the present invention is to punch holes in covers and sheets of a document or book. Thus the male strip 66 of a pair of binding strips is installed in the groove 63 with the studs 67 pointed upward. Pages 68 which have been punched by insertion in the throat 36 are positioned with the studs 67 passing through the holes in the pages 68. Thereupon a female binding strip 69 is placed over the studs 67.

A type of studs 67 particularly useful in the installation shown in FIGS. 7–10 is of flexible plastic rather than being rigid. The female strip 69 has channel-shaped grooves 70 on its upper surface communicating with the holes in strip 69. Preferably the upper longitudinal edges of the grooves 70 overhang. By bending the exposed ends of the studs 67 until they snap into the grooves 70 the pages 68 may be bound between the strips 66 and 69. Such a bending operation may be facilitated by use of a hand tool 71 having a curved end 72 which, when drawn along the top of the strip 69 sequentially bends the studs 67 downwardly. In a preferred embodiment of the invention, the studs 67 on the left hand end of the book are bent to the right and those on the right hand end are bent to the left, but it will be understood that this is an optional feature insofar as the punch of the present invention is concerned.

What is claimed is:

1. A paper punch comprising a base having a platen, sides, and an upstanding back, a die bar formed with die holes spaced at intervals supported by said base, a throat formed in said die bar, a punch bar, means guiding said punch bar for reciprocation toward and away from said die bar, said punch bar being formed on its underside with cavities at the same intervals as said die holes, a punch pin for each said cavity biased for movement with said punch bar and having a pin formed on its lower end with a die cooperable with said die holes to punch holes in sheets in said throat and spring means biasing said pin and said punch bar away from said die bar, said punch bar engaging the upper ends of all said pins, said die bar being formed with bores aligned with said die holes, a handle having a lever at its forward end and a first hook at its rearward end, a second hook formed on said back engageable with said first hook, said first and second hooks comprising means for pivotal movement of said handle relative to said base when said lever is depressed, means on a lower surface of said handle positioned above said punch bar to transmit pivotal movement of said lever to force simultaneous downward movement of said punch bar and said pins when said lever is depressed against the force of said spring means.

2. A punch according to claim 1 in which said first hook is disengageable from said second hook to permit removal of said handle and then removal of said punch bar and then any one or more said punch pins.

3. A punch according to claim 1 in which said punch bar is formed above each said cavity with an extension shaped to receive the upper end of one said pin, said cavity below said extension being shaped to receive said spring means.

4. A punch according to claim 3 in which the top of said die bar is formed with bosses bored in alignment with said bores, said bosses being dimensioned to be received in said cavities.

5. A punch according to claim 1 in which said die bar is separate from said base and is formed with first latch means and said base is formed with a support for the bottom of said die bar and second latch means, said first and second latch means being engageable to hold said die bar in place in said base.

6. A punch according to claim 5 in which said support is formed as an inverted channel, the sides of said channel having spaced ears and which further comprises a slug receptor having flanges formed with notches to accept said ears, whereby said flanges may be supported by said ears in one position of said receptor and released from said channel in a second position.

7. A punch according to claim 1 in which said base is formed with a groove extending transversely across said platen shaped to receive a bookbinding strip.

8. A paper punch comprising a base having a platen, sides, and an upstanding back, a die bar formed with die holes spaced at intervals supported by said base, a throat formed in said die bar, a punch bar, means guiding said punch bar for reciprocation toward and away from said die bar, said punch bar being formed on its underside with cavities at the same intervals as said die holes, a punch pin for each said cavity biased for movement with said punch bar and having a pin formed on its lower end with a die cooperable with said die holes to punch holes in sheets in said throat and spring means biasing said pin and said punch bar away from said die bar, said die bar being formed with bores aligned with said die holes, a handle having a lever at its forward end and a first hook at its rearward end, a second hook formed on said back engageable with said first hook forming a means for pivotal movement of said handle relative to said base when said lever is depressed, means on a lower surface of said handle to transmit pivotal movement of said lever to rectilinear movement of said punch bar and said pins against the force of said spring means, said lever, said punch bar and said punch pins being movable downward toward said base a first distance when said lever is depressed directly toward said base, said first hook interfitting inside said second hook a second distance less than said first distance, whereby, when said handle is pressed rectilinearly downward toward said base said second distance, said hooks disengage from each other, an upward pivotal movement of said handle relative to said base when said hooks are disengaged removes said handle from said punch, said punch bar being removable from said punch when said handle is removed, and any one or more of said punch pins being removable from said die bar when said punch bar is removed from said punch.

* * * * *